US005175910A

United States Patent [19]

Mizuno

[11] Patent Number: 5,175,910

[45] Date of Patent: Jan. 5, 1993

[54] LOCKABLE SLIDER FOR A SLIDE FASTENER

[75] Inventor: Hiroshi Mizuno, Toyama, Japan

[73] Assignee: Yoshida Kogyo K.K., Tokyo, Japan

[21] Appl. No.: 877,217

[22] Filed: May 1, 1992

[30] Foreign Application Priority Data

May 2, 1991 [JP] Japan ..... 3-130645

[51] Int. Cl.[5] ..... A44B 19/30

[52] U.S. Cl. ..... 24/421; 24/418

[58] Field of Search ..... 24/421, 418, 419, 420, 24/429; 70/68

[56] References Cited

U.S. PATENT DOCUMENTS 4,271,689 6/1981 Kasai ..... 24/418
4,422,220 12/1983 Oda ..... 24/421
4,438,550 8/1984 Oda ..... 24/418
4,719,673 1/1988 Kubo ..... 24/419
4,768,263 9/1988 Fukuroi et al. ..... 24/419

*Primary Examiner*—Victor N. Sakran
*Attorney, Agent, or Firm*—Hill, Van Santen, Steadman & Simpson

[57] ABSTRACT

A lockable slider for a slide fastener is disclosed which essentially comprises a slider body having a conneting neck or diamond and including an upper and a lower wing member defining therebetween a guide channel for the passage of slide fastener stringers and a locking member resiliently supported within the slider body. A switching means including a cam is provided for alternately locking and unlocking the slider with respect to the slide fastener, the cam being engageable with the locking member to move its locking prong portion away from the guide channel.

5 Claims, 4 Drawing Sheets

LOCKABLE SLIDER FOR A SLIDE FASTENER

BACKGROUND OF THE INVENTION

1. Field of the Invention

This invention relates to slide fasteners and more particularly a slider therefore which is switchable between locked and unlocked positions.

2. Prior Art

There are known various types of the so-called lockable sliders, a typical example of which is a slider having a key lock mechanism as disclosed for instance in Japanese Utility Model Publication No. 62-32415 and another example is a slider having a stopper means operatively associated with a slider pull tab as disclosed for instance in Japanese Utility Model Publication No. 56-37607. Most key-lock sliders are designed with the use of a key to keep the slider in locked position in which a locking prong extends into a guide channel for the passage of coupling element rows on slide fastener stringers and release the slider into unlocked position in which the locking prong is freely movable into and out of the guide channel, or alternatively switch the key to hold the locking prong retracted away from the guide channel. Sliders of the other type are constructed such that a stopper means often in the form of a locking prong integral with the pull tab is retracted from the guide channel by pulling the pull tab in one or the other direction and brought into engagement in between the coupling elements by flipping the pull tab flat against the slider body to prevent unintentional movement of the slider along the slide fastener. Since the latter type of lockable slider is easily released from its locked position by manipulating the pull tab, the user would often unconsciously leave his garment or bag with the slider unlocked thereon, posing a theft or other security problem. Whereas, the key locking type of slider literally requires the user to carry with him a key in which instance such key is liable to get lost. It would also be embarrassing to put a key on a person. Furthermore, keys are by nature tedious to handle and hence would often be left unused.

SUMMARY OF THE INVENTION

With the foregoing problems of the prior art in view, the present invention seeks to provide an improved slider for a slide fastener which incorporates means of switching the slider from locked position to unlocked position, or vice versa, with utmost ease and accuracy and without the use of a key.

According to the invention, there is provided a lockable slider for a slide fastener which comprises a slider body including an upper wing member and a lower wing member joined at one end of the slider body by a connecting neck so as to define therebetween a generally Y-shaped guide channel, the slider body having a cavity formed in its lower surface spanning between the connecting neck and the lower wing member, a pull tab pivotably supported on the slider body, a locking member resiliently supported within the slider body and having a barrel portion overlying the cavity and a locking prong portion movable into and away from the guide channel, and a switching means comprising a pivotal pin extending vertically through the connecting neck and a cam ring connecting to the pin and having a camming portion engageable with the locking member to retract the locking prong portion from the guide channel.

The above and other objects, features and advantages of the invention will be better understood from the following detailed description taken in conjunction with the accompanying drawings which illustrate by way of example a preferred embodiment. Like reference numerals refer to like or corresponding parts throughout the several views.

DETAILED DESCRIPTION OF THE INVENTION

Figure 1:
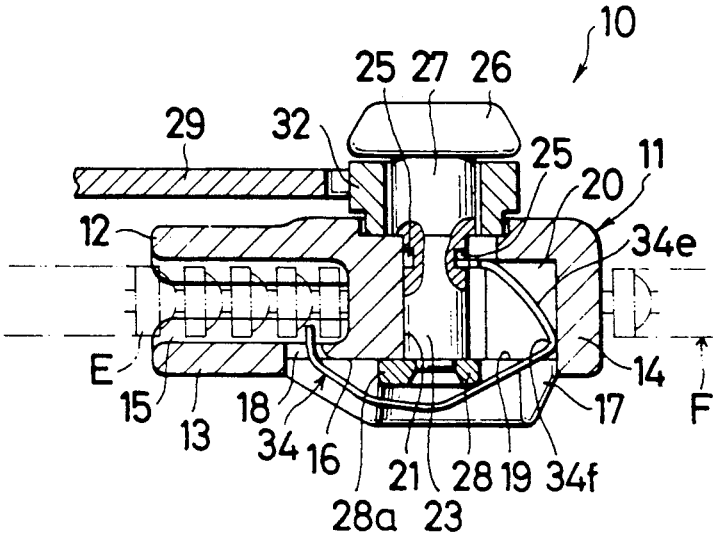
FIG. 1 is a longitudinal cross-sectional view of a lockable slider according to the invention, showing the same in locked or inoperative position.
Figure 2:
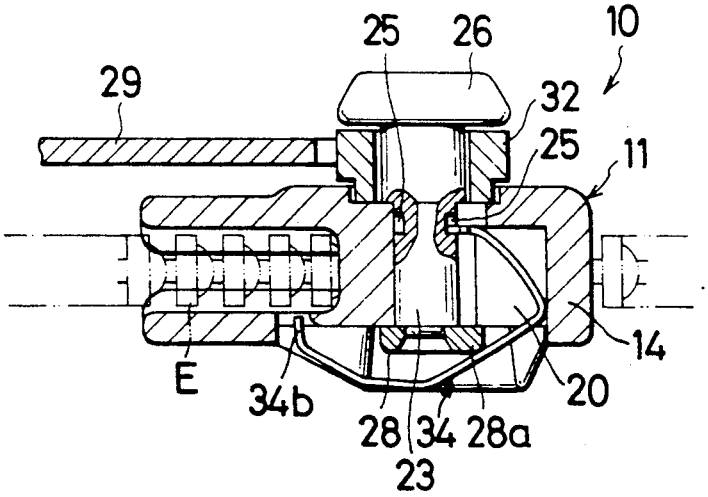
FIG. 2 is a view similar to FIG. 1 but showing the slider in unlocked or operative position.
Figure 3:
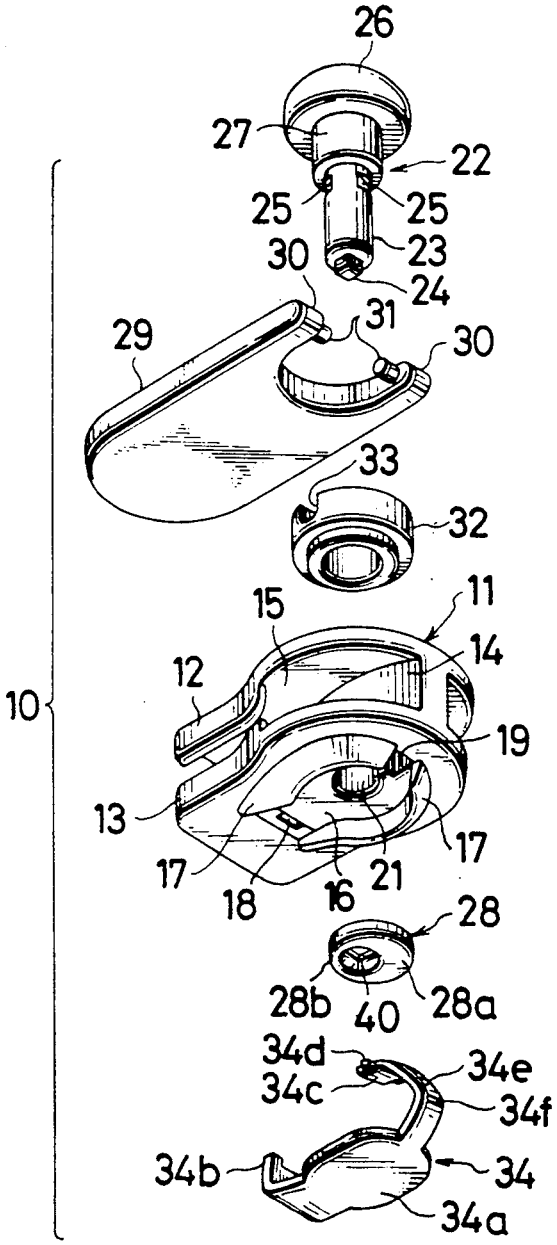
FIG. 3 is an exploded perspective view of the slider of FIG. 1.
Figure 4:
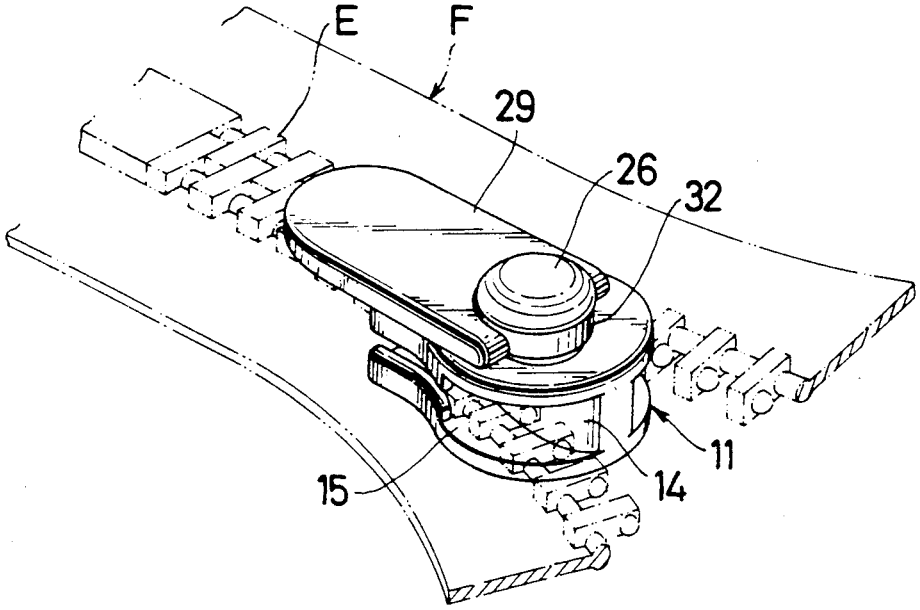
FIG. 4 is a fragmentary perspective view of a slide fastener on which the slider of the invention is mounted.
Figure 5:
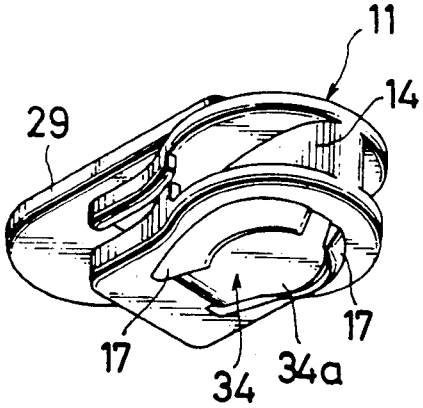
FIG. 5 is a perspective back view of the slider.
Figure 6:
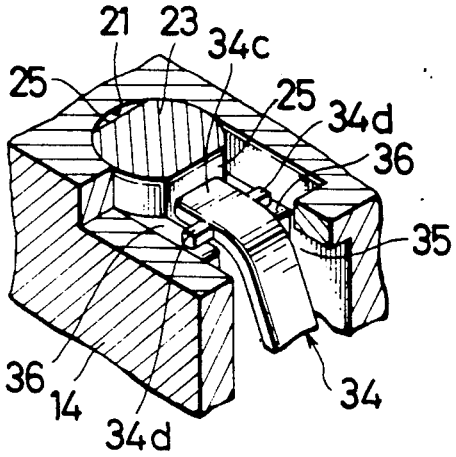
FIG. 6 is a perspective view of the slider partly broken away to reveal a portion of its interior.

Referring now to the drawings and FIGS. 1-3 in particular, there is shown a lockable slider 10 embodying the invention which is mounted on and reciprocally movable along a pair of fastener stringers F to take rows of coupling elements E thereon into and out of engagement with each other. The slider 10 comprises a slider body 11 including an upper wing member 12 and a lower wing member 13 joined at one end of the slider body 11 by a connecting neck or diamond 14 so as to define therebetween a generally Y-shaped guide channel 15 for the passage therethrough of the stringers F.

The slider body 11 is provided with a cavity 16 which is surrounded on opposite sides by a pair of downwardly projecting fences 17 and which terminates at one end in the lower surface of the lower wing member 13 and at the opposite end in the lower surface of the connecting neck 14. The cavity 16 communicates through a first opening 18 with the guide channel 15 and through a second opening 19 with a chamber 20 formed in the connecting neck 14.

A center bore 21 round in cross section extends vertically through the connecting neck 14, spanning between the upper and lower wing members 12 and 13 and is adapted to receive a switching means 22. The switching means 22 comprises, as better shown in FIG. 3, a pivotal pin 23 having a round cross section such that it snugly fits in movable relation to the bore 21 and provided at its lower end with a square nut portion 24 and a pair of diametrically opposed recessed abutments 25, an operating knob 26, a hub 27 interconnected between the knob 26 and the pin 23, and a cam ring 28 having a square opening 40 dimensioned to fit with and receive the nut portion 24 of the pin 23.

A pull tab 29 for manipulating the slider 10 is bifurcated at one end to provide a pair of confronting arms 30 each having inwardly directed support lugs 31.

An annular sleeve 32 substantially as large as the knob 26 is fitted movably over the hub 27 and interconnected between the knob 26 and the upper surface of the upper wing member 12. The sleeve 32 has a pair of diametrically opposed recesses 33 for receiving the respective support lugs 31 of the pull tab 29 in such a manner that the pull tab 29 can rotate relative to the slider body 11 in a plane both perpendicular and parallel to the general plane of the slider body 11. This arrangement is intended to deceive or camouflage the function of the switching means 22 with the false impression that the operating knob 26 serves as a cap to cover and retain the hub 27 in place.

A locking member 34 made preferably from a resilient material is in the form of a polygonal leaf spring resiliently supported within the slider body 11 and having a barrel portion 34*a* substantially coextensive with and overlying the cavity 16 in the bottom of the slider body 11, a locking prong portion 34*b* extending upwardly from one end of the barrel portion 34*a* and movable, as later described, into and away from the guide channel 15 and an abutting lug portion 34*c* extending from the opposite end of the barrel portion 34*a* and engageable alternately with the two abutments 25 of the switching means 22 through a horizontal opening 35 communicating with the chamber 20.

The lug portion 34*c* of the locking member 34 has a pair of support pins 34*d* extending from opposite sides thereof and borne against respective ledges 36 inwardly directed from an inner wall of the connecting neck 14 of the slider body 11. The locking member 34 further includes a V-shaped bend 34*e* interconnected between the barrel portion 34*a* and the abutting lug portion 34*c* and having its corner 34*f* borne against a vertical wall of the chamber 20. The locking member 34 thus polygonally shaped is mounted in place within the slider body 11 so that the lug portion 34*c* is normally biased by the tension of the resiliently formed locking member 34 in a direction to come into abutting engagement with the abutments 25. Thus, the lug portion 34*c* and the two abutments 25 jointly form a ratchet mechanism such that the former snaps into engagement with one or the other of abutments 25 as the operating knob 26 is turned 180° in either direction.

As better shown in FIG. 3, the cam ring 28 has its opening 40 formed eccentrically thereof to provide a camming portion 28*a* radially outwardly projecting from the center of the opening 40 and diametrically opposed to a non-camming portion 28*b*. The cam ring 28 is fitted in place over the nut portion 24 of the pivotal pin 23 with the camming and non-camming portions 28*a* and 28*b* registered respectively in alignment with the recessed abutments 25.

With this construction, the lockable slider 10 is switchable between locked and unlocked positions with respect to the fastener stringers F. This is done by rotating the operating knob 26 180° in one direction to disengage the camming portion 28*a* of the cam ring 28 from the barrel portion 34*a* of the locking member 34, whereupon the locking prong portion 34*b* is urged resiliently upwardly into the guide channel 15 to engage in between adjacent coupling elements E of the stringers F thereby locking the slider 10 against displacement, as shown in FIG. 1. Rotating the operating knob 26 180° in the opposite direction will bring the camming portion 28*a* of the cam ring 28 into pressure engagement with the barrel portion 34*a* of the locking member 34, whereupon the locking prong portion 34*b* is biased downwardly to retract away from the guide channel 15 as shown in FIG. 2, thereby unlocking and allowing the slider 10 to be moved by the pull tab 29 to open or close the fastener stringers F in a manner well known in the art.

Figure 7:
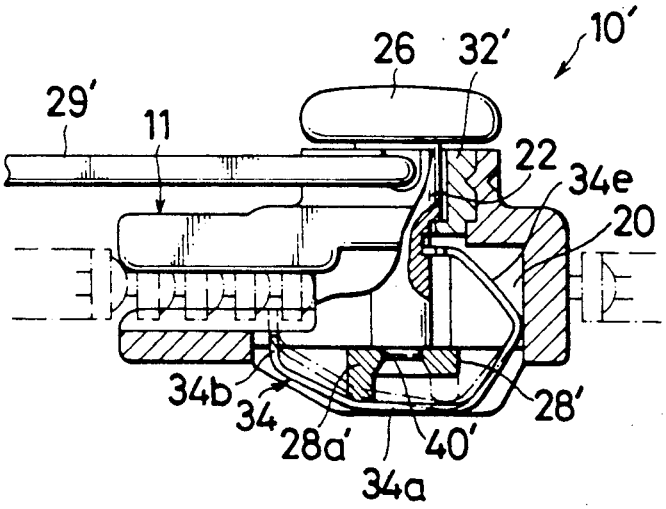
FIG. 7 is a longitudinal, partly sectional, elevational view of a modified form of lockable slider according to the invention.

FIG. 7 shows a modified form of lockable slider 10' in which the annular sleeve 32' is fixedly connected to the slider body 11 so that the pull tab 29' cannot swivel in a plane parallel to the general plane of the slider body 11. This arrangement precludes camouflage consideration noted above in connection with the lockable slider 10 shown in FIGS. 1–6. The modified lockable slider 10' of FIG. 7 features the provision of a cam ring 28' which has an opening 40' formed concentrically thereof with one of two diametrically opposed portions projecting downwardly to provide a camming portion 28*a'* for pressure engagement with the locking member 34 which may be made from non-resilient material, the remaining structural details being substantially identical with the lockable slider 10.

Obviously, various modifications and variations of the present invention are possible in the light of the above teaching. It is therefore to be understood that within the scope of the appended claims the invention may be practiced otherwise than as specifically described.

What is claimed is:

1. A lockable slider for a slide fastener which comprises a slider body including an upper wing member and a lower wing member joined at one end of said slider body by a connecting neck so as to define therebetween a generally Y-shaped guide channel, said slider body having a cavity formed in its lower surface spanning between said connecting neck and said lower wing member, a pull tab pivotably supported on said slider body, a locking member resiliently supported within said slider body and having a barrel portion overlying said cavity and a locking prong portion movable into and away from said guide channel, and a switching means comprising a pivotal pin extending vertically through said connecting neck and a cam ring connected to said pin and having a camming portion engageable with said locking member to retract said locking prong portion from said guide channel.

2. A lockable slider according to claim 1 further including an annular sleeve fitted on said switching means and adapted to support said pull tab pivotably in a plane both perpendicular and parallel to the general plane of said slider body.

3. A lockable slider according to claim 1 wherein said cam ring has an opening formed eccentrically thereof to provide said camming portion radially outwardly projecting from the center of said opening for pressure engagement with said locking member.

4. A lockable slider according to claim 1 wherein said cam ring has an opening formed concentrically thereof to provide said camming portion projecting downwardly for pressure engagement with said locking member.

5. A lockable slider according to claim 1 wherein said pivotal pin has a pair of diametrically opposed recessed abutments for alternate engagement in a ratchet relation with said locking member.

* * * * *